US005992504A

United States Patent [19]

Kumazawa et al.

[11] Patent Number: 5,992,504

[45] Date of Patent: Nov. 30, 1999

[54] HONEYCOMB REGENERATOR

[75] Inventors: Kazuhiko Kumazawa, Nagoya; Wataru Kotani, Kasugai; Masaomi Kamiya, Chiryu, all of Japan

[73] Assignee: NGK Insulators, Ltd., Japan

[21] Appl. No.: 08/488,056

[22] Filed: Jun. 7, 1995

[30] Foreign Application Priority Data

Jun. 17, 1994 [JP] Japan ..... 6-135745
Sep. 29, 1994 [JP] Japan ..... 6-235411

[51] Int. Cl.[6] ..... F23L 15/02

[52] U.S. Cl. ..... 165/9.2; 165/9.1; 165/9.4; 165/10

[58] Field of Search ..... 165/9.2, 9.1, 10, 165/9.4, 165

[56] References Cited

U.S. PATENT DOCUMENTS

| | | | |
|---|---|---|---|
| 2,598,262 | 5/1952 | Janson | 165/9.2 |
| 3,326,541 | 6/1967 | Davies et al. | 165/9.2 |
| 4,143,704 | 3/1979 | Kandakov et al. | 165/9.2 |
| 4,489,774 | 12/1984 | Ogawa et al. | 165/10 |
| 4,513,807 | 4/1985 | Rose et al. | 165/10 |
| 4,601,332 | 7/1986 | Oda et al. | 165/165 |
| 4,658,887 | 4/1987 | Matsuhisa et al. | 165/10 X |
| 4,877,670 | 10/1989 | Hamanaka | 165/10 X |
| 4,974,666 | 12/1990 | Hirata et al. | 165/9.1 |

FOREIGN PATENT DOCUMENTS

| | | | |
|---|---|---|---|
| 0361883 | 4/1990 | European Pat. Off. | F28D 19/04 |
| 2545917 | 11/1984 | France | F28D 5/00 |
| 2746868 | 4/1979 | Germany | 165/9.2 |
| 58-26036 | 2/1983 | Japan | C03B 5/16 |
| 0175792 | 10/1983 | Japan | 165/9.2 |
| 2-23950 | 6/1990 | Japan | F23D 14/12 |
| 4-251190 | 9/1992 | Japan | F28D 17/02 |
| 2128724 | 5/1984 | United Kingdom | F28D 17/02 |

OTHER PUBLICATIONS

Engineered Materials Handbook, Ceramics and Glass, ASM International, N.Y., 1991, pp. 759 and 896–897, TA403E.497, vol. 4.

*Primary Examiner*—Christopher Atkinson
*Attorney, Agent, or Firm*—Parkhurst & Wendel, L.L.P.

[57] ABSTRACT

A honeycomb regenerator for recovering waste heat from exhaust gas, comprises a stacked assembly including at least one first honeycomb body and at least one second honeycomb body stacked thereon, the first honeycomb body being formed of an anti-corrosive material, and the at least one second honeycomb body being formed of a material having a main phase of cordierite. The stacked assembly has an inlet for hot gas and an inlet for cold gas, such that the cold gas flows along a direction opposite the hot gas. Further, the at least one second honeycomb body is provided downstream of the at least one first honeycomb body along a gas flow direction of the hot gas. Accordingly, the at least one first honeycomb body receives the hot gas during flow thereof, while the at least one second honeycomb body receives the cold gas during flow thereof.

11 Claims, 2 Drawing Sheets

HONEYCOMB REGENERATOR

BACKGROUND OF THE INVENTION

1. Field of the Invention

The present invention relates to a honeycomb regenerator for recovering a waste heat in an exhaust gas by passing the exhaust gas and gas to be heated alternately therethrough, which is constructed by stacking a plurality of honeycomb structural bodies each having a rectangular shape in such a manner that flow passages constructed by through-holes are aligned in one direction, and especially relates to the honeycomb regenerator used in a corrosive atmosphere.

2. Related Art Statement

In combustion heating furnaces used in industry such as a blast furnaces, an aluminum melting furnace, a glass melting furnaces or the like, a regenerator used for improving a heat efficiency, in which a firing air is pre-heated by utilizing waste heat of an exhaust gas, has been known. As such regenerators, Japanese Patent Laid-Open Publication No. 58-26036 (JP-A-58-26036) discloses a regenerator utilizing ceramic balls, and also Japanese Patent Laid-Open Publication No. 4-251190 (JP-A-4-251190) discloses a regenerator utilizing honeycomb structural bodies.

In the known regenerator mentioned above, at first an exhaust gas having a high temperature is brought into contact with the ceramic balls or the honeycomb structural bodies to store a waste heat of the exhaust gas in the regenerator, and then a gas to be heated having a low temperature is brought into contact with the thus pre-heated regenerator to heat the gas to be heated, thereby utilizing the waste heat in the exhaust gas effectively.

Among the known regenerators mentioned above, in the case of using the ceramic balls, since a contact area between the ceramic balls and the exhaust gas is small due to a large gas-flowing resistivity of the ceramic balls, it is not possible to perform a heat exchanging operation effectively. Therefore, there occurs a drawback such that it is necessary to make a dimension of the regenerator large.

Contrary to this, in the case of using the honeycomb structural bodies, since a geometrically specific surface thereof is large as compared with a volume thereof, it is possible to perform the heat exchanging operation effectively even by a compact body. However, in an actual industrial furnace, since use is made of a natural gas, a light oil, a heavy oil or the like as a fuel, a corrosive gas such as SOx, NOx or the like is generated. Moreover, in the aluminum melting furnace, the exhaust gas includes an alkali metal component or the like. Therefore, a catalyst carrier made of cordierite used for purifying the exhaust gas of an automobile as disclosed in JP-A-4-251190 has a drawback on anti-corrosive properties.

Further, in order to improve the anti-corrosive properties, Japanese Utility Model Publication No. 2-23950 discloses a regenerator utilizing alumina. In this case, since the entire honeycomb body is made of an alumina and an alumina has a high thermal expansion coefficient, there occurs a problem such that the regenerator is fractured due to a thermal shock if a heat cycle having a large temperature difference is applied thereto.

SUMMARY OF THE INVENTION

An object of the present invention is to eliminate the drawbacks mentioned above and to provide a honeycomb regenerator which can perform a heat exchanging operation effectively even in a corrosive atmosphere.

According to the invention, a honeycomb regenerator for recovering waste heat in an exhaust gas by passing said exhaust gas and a gas to be heated alternately therethrough, which is constructed by stacking a plurality of honeycomb structural bodies, is characterized in that said honeycomb structural bodies arranged in a portion, to which said exhaust gas having a high temperature is contacted, are made of ceramics having anti-corrosive properties, and said honeycomb structural bodies arranged in a portion, to which said gas to be heated having a low temperature is contacted, are made of cordierite as a main crystal phase.

In the construction mentioned above, the portion of the honeycomb regenerator, to which the exhaust gas having a high temperature is contacted, is formed by the honeycomb structural bodies made of ceramics having the anti-corrosive properties, and the portion of the honeycomb regenerator, to which the gas to be heated having a low temperature is contacted, is formed by the honeycomb structural bodies made of cordierite. Therefore, since the problems in the case of using the ceramics having the anti-corrosive properties or the cordierite only as the honeycomb structural bodies can be eliminated, it is possible to perform the heat exchanging operation of the honeycomb regenerator effectively even in the corrosive gas having a high temperature.

DESCRIPTION OF THE PREFERRED EMBODIMENT

Figure 1:
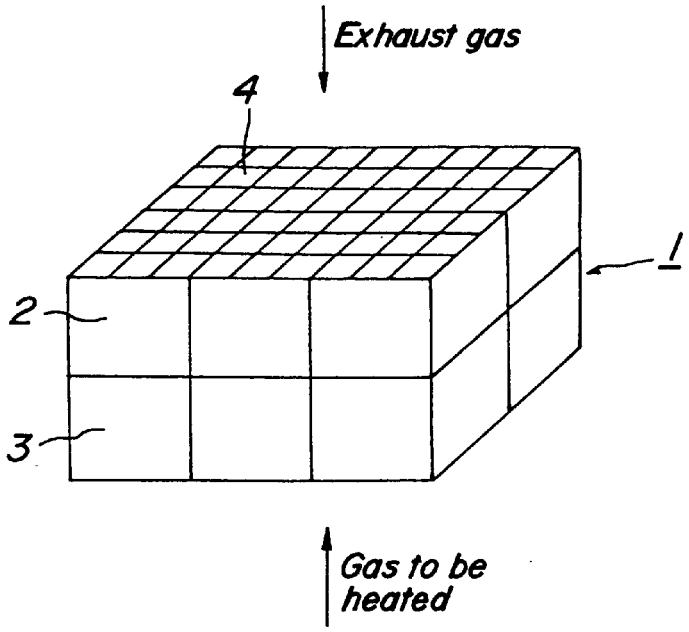
FIG. 1 is a schematic view showing one embodiment of a honeycomb regenerator according to the invention.

FIG. 1 is a schematic view showing one embodiment of a honeycomb regenerator according to the invention. In the embodiment shown in FIG. 1, a honeycomb regenerator 1 is formed by stacking a plurality of honeycomb structural bodies 2 having anti-corrosive properties and a plurality of cordierite honeycomb structural bodies 3 in such a manner that flow passages thereof constructed by through-holes 4 are aligned in one direction. The honeycomb structural bodies 2 having anti-corrosive properties are made of a material selected from a group consisting of alumina, zirconia, mullite, SiC, $Si_3N_4$ as a main crystal phase. The cordierite honeycomb structural bodies 3 are made of cordierite as a main crystal phase. Moreover, both of the honeycomb structural bodies 2 and 3 have a rectangular shape.

In this embodiment, a portion of the honeycomb regenerator 1 to which an exhaust gas having a high temperature is contacted, i.e., six honeycomb structural bodies forming an upper plane of the honeycomb regenerator 1 in FIG. 1 are constructed by the honeycomb structural bodies 2 having anti-corrosive properties. Moreover, a portion of the honeycomb regenerator 1 to which a gas to be heated having a low temperature is contacted, i.e., six honeycomb structural bodies forming a lower plane of the honeycomb regenerator 1 in FIG. 1 are constructed by the cordierite honeycomb structural bodies 3. In this case, six honeycomb structural bodies 2 having anti-corrosive properties may be formed by the same material or may be formed by different materials within the group mentioned above.

Further, from the view point of the anti-corrosive properties, it is preferred to set a length in the flow passage direction of a layer in which six honeycomb structural bodies 2 having anti-corrosive properties exist to more than 2cm from a surface of an exhaust gas inlet, and it is more preferred to set the length mentioned above to more than 5 cm. Moreover, it is preferred to set the length mentioned above to less than 9/10 of a whole length of the honeycomb regenerator 1, and it is more preferred to set the length mentioned above to less than 2/3 of the whole length mentioned above. Furthermore, from the view point of improving heat storing properties and strength, it is preferred to set a porosity of the cordierite honeycomb structure bodies 3 to 20~50%. Moreover, from the view point of removing a corrosive exhaust gas component, it is effective to set a porosity of the honeycomb structural body 2 having anti-corrosive properties larger than that of the cordierite honeycomb structural body 3.

In the present invention, the reason for limiting the length of arranging the anti-corrosive honeycomb structural body 2 to preferably more than 2 cm, more preferably more than 5 cm is as follows. That is to say, since a corrosion of the portion, to which the exhaust gas having a high temperature is directly contacted, becomes extraordinary, it is necessary to use the anti-corrosive honeycomb structural body 2 having at least such a thickness mentioned above. Moreover, the reason for limiting the length of arranging the anti-corrosive honeycomb structural body 2 to preferably less than 9/10, more preferably less than 2/3 of the whole length of the honeycomb regenerator 1 is as follows. That is to say, since a large thermal shock is applied to the portions, to which an air having a room temperature is generally contacted, it is necessary to use the cordierite honeycomb structural body 3 with a good thermal shock property having preferably not less than 1/10, more preferably not less than 1/3 of the whole length mentioned above.

Further, the reason for limiting a porosity of the cordierite honeycomb structural body 3 to preferably 20~50% is as follows. That is to say, a heat storing property is increases as porosity of the honeycomb structural body 3 increases. Thus, it is preferred to have a porosity at least more than 20%. Moreover, since strength decreases as a porosity of the honeycomb structural body 3 increases, an upper limit of the porosity is preferably less than 50%. Moreover, the reason for preferably limiting a porosity of the anti-corrosive honeycomb structural body 2 larger than that of the cordierite honeycomb structural body 3 in a corrosive atmosphere is as follows. That is to say, in this case, a corrosive exhaust gas component can be temporarily trapped by a high temperature portion i.e. the anti-corrosive honeycomb structural bodies 2, and an amount of the corrosive exhaust gas component passing through a low temperature portion i.e. the cordierite honeycomb structural bodies 3 can be reduced.

In the embodiment shown in FIG. 1, one layer is constructed by six anti-corrosive honeycomb structural bodies 2 and the other layer is constructed by six cordierite honeycomb structural bodies 3. However, it should be noted that the number of the honeycomb structural bodies forming one layer and the number of the stacking layers are not limited. The important point of the present invention is that, if the honeycomb structural body is constructed by the honeycomb structural bodies in any way, the anti-corrosive honeycomb structural bodies 2 are arranged at least to the portion to which the high temperature exhaust gas is contacted, and also the cordierite honeycomb structural bodies 3 are arranged at least to the portion to which the low temperature gas to be heated is contacted. In the case of using multiple i.e. more than two layers of the honeycomb structural bodies, use is made of both the anti-corrosive honeycomb structural body 2 and the cordierite honeycomb structural body 3 as an intermediate layer, but it is preferred to satisfy the preferable conditions mentioned above.

In the honeycomb regenerator 1 shown in FIG. 1, at first the high temperature exhaust gas is flowed downwardly through the honeycomb regenerator 1 for a predetermined time period to store heat in the honeycomb regenerator 1, and then after changing the flow direction the low temperature gas to be heated is flowed upwardly through the honeycomb regenerator 1 for a predetermined time period to heat the gas. Therefore, it is possible to perform the heat exchanging operation effectively by repeating the operation mentioned above.

As for a material of the anti-corrosive honeycomb structural bodies 2, it is possible to use one or more materials selected from a group of alumina, zirconia, mullite, SiC, $Si_3N_4$ as a main crystal phase as mentioned above, but, in this case, it is preferred to select the materials by taking into account properties mentioned below. Alumina and zirconia have a resistivity to a corrosion, but have a large thermal expansion coefficient (CTE), so that they have relatively poor thermal shock resistivity. Mullite has a superior corrosion resistivity as compared with that of cordierite, but it is inferior as compared with that of alumina. Further, mullite has an excellent thermal shock resistance as compared with that of alumina. SiC and $Si_3N_4$ have an excellent corrosion resistivity and have an intermediate thermal expansion coefficient. Therefore, they have an excellent thermal shock resistivity, but there occurs a problem of a deterioration due to an oxidization in an oxidizing atmosphere. The properties mentioned above are summarized in the following Table 1.

TABLE 1

| | cordierite | almina | zirconia | mullite | SiC | $Si_3N_4$ |
|---|---|---|---|---|---|---|
| CTE ($\times 10^{-6}$/° C.) | 0.6 | 7.8 | 7.8 | 4.5 | 3.5 | 3.5 |
| Corrosion resistivity | X | ○ | ○ | Δ | ○ | ○ |
| oxidization resistivity | ○ | ○ | ○ | ○ | X | X |
| Specific gravity | 2.52 | 3.98 | 6.27 | 3.16 | 3.22 | 3.17 |

As a method of using the anti-corrosive ceramics, since alumina and zirconia have a worse thermal shock resistivity, it is effective to make it into blocks as small as possible in an actual use. Moreover, since they have an excellent corrosion resistivity, it is possible to make a porosity thereof high. If the porosity thereof is increased, it is effective to store a heat therein, and it is possible to reduce an amount of the corrosive gas passing through the cordierite portion by trapping the corrosive gas temporarily therein.

Mullite has a superior thermal shock resistivity as compared with alumina, but a corrosion resistivity thereof is not sufficient. If a porosity of mullite is decreased to less than 10%, mullite has a sufficient corrosion resistivity in an actual use. SiC and $Si_3N_4$ have an intermediate thermal expansion coefficient and have a good thermal shock resistivity as is not the same as that of cordierite. Moreover, since they have an excellent corrosion resistivity, they can be used in a reduction atmosphere. However, if SiC and $Si_3N_4$ are used in a high temperature oxidizing atmosphere above 1000° C., $SiO_2$ glass is generated on a surface thereof due to the oxidization, and a thermal expansion coefficient thereof becomes high. Moreover, they are liable to be deteriorated by the corrosive gas such as SOx, NOx or the like. In this case, in order to increase the oxidization resistivity, it is preferred to form a dense body having a porosity of less than 10%. As a method of making a porosity of SiC to less than 10%, it is effective to include Si in SiC. SiC honeycomb including Si having a porosity of less than 10% shows an excellent oxidization resistivity, a high thermal expansion coefficient and an excellent thermal shock resistance, and thus it can be preferably used for the anti-corrosive ceramics.

As for a heat storing property, it is effective to be a porous body from the view point of a heat conductivity and also it is effective to use a body having a high bulk specific gravity i.e. a heavy body from the view point of a specific heat. Cordierite has a relatively low specific gravity, but a cordierite porous body having a porosity of more than 20% shows a sufficient heat storing property. Alumina and zirconia have a high specific gravity, and thus an alumina body or a zirconia body having a high porosity is effective for a heat storing body. SiC and $Si_3N_4$ are preferably used as a densified body having a porosity of less than 10% so as to improve the oxidization resistivity. They have a worse heat storing property, but, since a specific gravity thereof is high, they have expectedly the same heat storing property as that of cordierite.

Figure 2:
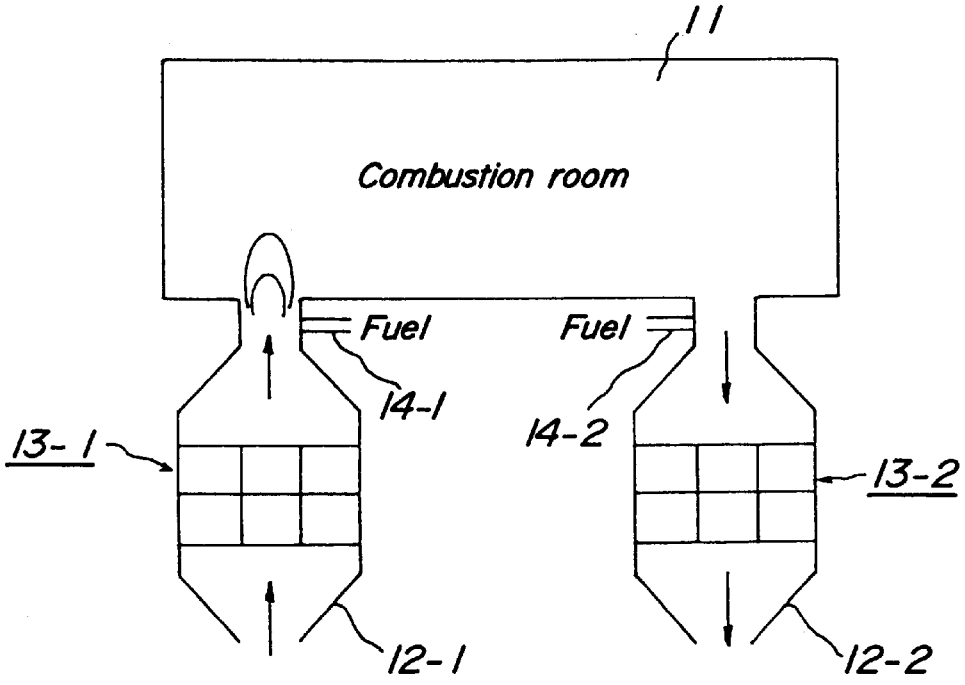
FIG. 2 is a schematic view illustrating one embodiment such that a heat exchanging apparatus utilizing the honeycomb regenerator according to the invention is applied to a combustion room of a combustion heating furnace.

FIG. 2 is a schematic view showing one embodiment such that a heat exchanging apparatus utilizing the honeycomb regenerator according to the invention is applied to a combustion room of a combustion heating furnace. In the embodiment shown in FIG. 2, a numeral 11 is a combustion room, numerals 12-1 and 12-2 are a honeycomb regenerator having a construction shown in FIG. 1, numerals 13-1 and 13-2 are a heat exchanging apparatus constructed by the honeycomb regenerator 12-1 or 12-2, and numeral 14-1 and 14-2 are a fuel supply inlet of the heat exchanging apparatus 13-1 or 13-2. In the embodiment shown in FIG. 2, two heat exchanging apparatuses 13-1 and 13-2 are arranged for performing the heat storing operation and the heating operation at the same time. That is to say, when one of them performs the heat storing operation, the other can perform the heating operation at the same time, thereby performing the heat exchanging operation effectively. As shown by arrow in FIG. 2, an air to be heated is supplied upwardly in the heat exchanging apparatus 13-1 in which the honeycomb regenerator 12-1 is pre-heated by storing a heat, and, at the same time, an exhaust gas having a high temperature is supplied from the combustion room 11 to the heat exchanging apparatus 13-2. Moreover, a fuel is supplied in the heat exchanging apparatus 13-1 via the fuel supply inlet 14-1 at the same time. Therefore, the pre-heated air is supplied in the combustion room 11 with fuel, and the honeycomb regenerator 12-2 of the heat exchanging apparatus 13-2 is pre-heated.

Then, the gas flows are changed in a reverse direction with respect to the arrows in FIG. 2. After that, air to be heated is supplied upwardly in the heat exchanging apparatus 13-2, and, at the same time, an exhaust gas having a high temperature is supplied from the combustion room 11 to the heat exchanging apparatus 13-1. In the embodiment mentioned above, the heat exchanging operation can be performed by repeating continuously the steps mentioned above.

The present invention is not limited to the embodiments mentioned above, and various variations are possible. For example, as a combination method of the anti-corrosive honeycomb structural bodies, it is possible to use one layer or two or three layers of the honeycomb structural bodies made of SiC as a main crystal phase having an excellent thermal shock resistivity at the high temperature portion and to use a few layers of the honeycomb structural bodies made of alumina as a main crystal phase having an excellent corrosion resistivity, which is arranged inside of the SiC honeycomb structural bodies.

Figure 3:
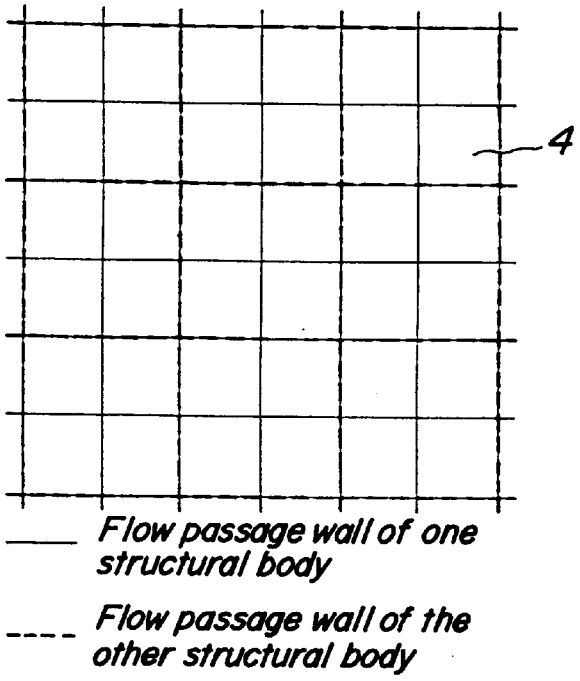
FIG. 3 is a schematic view for explaining one embodiment of flow passages of the honeycomb regenerator according to the invention.
Figure 4:
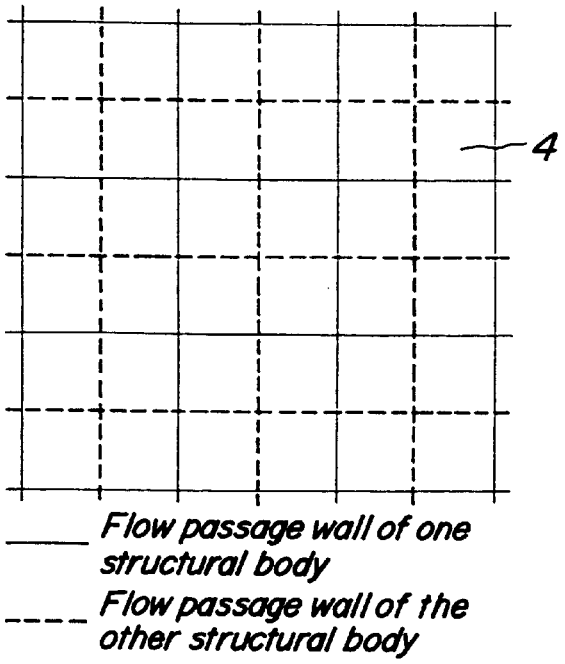
FIG. 4 is a schematic view for explaining another embodiment of flow passages of the honeycomb regenerator according to the invention.

Moreover, it is preferred to align the flow passages of the honeycomb structural bodies, which are constructed by the through-holes 4, in one direction. However, it is possible to use the honeycomb structural bodies having different flow passage density defined by the number of flow passages with respect to a unit area. For example, as shown in FIG. 3, it is possible to use the construction such that the flow passage density of one of the honeycomb structural bodies consisting of an upper or a lower layer is two times or more than three times as large as that of the other honeycomb structural bodies consisting of the lower or the upper layer. Moreover, it is possible to use the construction such that positions of flow passage walls of the honeycomb structural bodies are not made identical with each other. That is to say, as shown in FIG. 4, it is possible to use the construction such that the upper honeycomb structural bodies and the lower honeycomb structural bodies are stacked in such a manner that they are slid with each other by a half or one third of a length between the flow passage walls.

As clearly understood from the above explanation, according to the invention, since the portion, to which the high temperature exhaust gas is contacted, is constructed by the anti-corrosive honeycomb structural bodies and the portion to which the low temperature gas to be heated is contacted, is constructed by the cordierite honeycomb structural bodies, it is possible to perform the heat exchanging operation effectively without being fractured even in the high temperature corrosive gas.

What is claimed is:

1. A honeycomb regenerator for recovering waste heat from exhaust gas, comprising:

a stacked assembly including at least one first honeycomb body and at least one second honeycomb body stacked on said at least one first honeycomb body, each honeycomb body including a plurality of passages extending along an axial direction of the stacked assembly, said at least one first honeycomb body comprising a ceramic material having anti-corrosive properties, and said at least one second honeycomb body comprising a ceramic material having a main crystal phase of cordierite, said stacked assembly including first and second opposite axial ends respectively forming an inlet for hot exhaust gas and an inlet for cold gas, wherein said at least one second honeycomb body is provided downstream of said at least one first honeycomb body along a flow direction of the hot exhaust gas.

2. The honeycomb regenerator of claim 1, wherein said at least one first honeycomb body comprises a ceramic material having a main crystal phase selected from the group consisting of alumina, zirconia, mullite, silicon carbide and silicon nitride.

3. The honeycomb regenerator of claim 1, wherein the at least one first honeycomb body has an axial length greater than 2 cm and less than 9/10 of the entire axial length of the stacked assembly.

4. The honeycomb regenerator of claim 3, wherein the axial length of the at least one first honeycomb body is greater than 5 cm and less than 2/3 of the entire length of the stacked assembly.

5. The honeycomb regenerator of claim 1, wherein the at least one second honeycomb body has a porosity within a range of 20–50%.

6. The honeycomb regenerator of claim 5, wherein the at least one first honeycomb body has a porosity which is greater than the porosity of the at least one second honeycomb body.

7. The honeycomb regenerator of claim 6, wherein the at least one first honeycomb body comprises a main crystal phase of alumina.

8. The honeycomb regenerator of claim 6, wherein the at least one first honeycomb body comprises a main crystal phase of zirconia.

9. The honeycomb regenerator of claim 2, wherein said at least one first honeycomb body comprises a material having a main crystal phase of silicon carbide or silicon nitride and has a porosity less than 10%.

10. The honeycomb regenerator of claim 9, wherein the at least one first honeycomb body comprises silicon carbide as a main crystal phase, and further includes silicon.

11. The honeycomb regenerator of claim 2, wherein the at least one first honeycomb body comprises a material having a main crystal phase of mullite, the at least one first honeycomb body having a porosity less than 10%.

* * * * *